US008284051B2

(12) United States Patent
Takada et al.

(10) Patent No.: US 8,284,051 B2
(45) Date of Patent: Oct. 9, 2012

(54) SECURITY SYSTEM, SECURITY CENTER APPARATUS, AND SECURITY MANAGEMENT METHOD

(75) Inventors: Yasuaki Takada, Kiyose (JP); Hisashi Nagano, Nishitokyo (JP)

(73) Assignee: Hitachi, Ltd., Tokyo (JP)

( * ) Notice: Subject to any disclaimer, the term of this patent is extended or adjusted under 35 U.S.C. 154(b) by 326 days.

(21) Appl. No.: 12/357,447

(22) Filed: Jan. 22, 2009

(65) Prior Publication Data

US 2009/0184820 A1 Jul. 23, 2009

(30) Foreign Application Priority Data

Jan. 22, 2008 (JP) ..... 2008-011064

(51) Int. Cl.
*G08B 21/00* (2006.01)

(52) U.S. Cl. ..... 340/540; 340/573.1

(58) Field of Classification Search ..... 340/540, 340/573.1

See application file for complete search history.

(56) References Cited

U.S. PATENT DOCUMENTS

| | | | | |
|---|---|---|---|---|
| 5,105,365 | A * | 4/1992 | McDaniel et al. | 702/24 |
| 2002/0024442 | A1* | 2/2002 | Nishikawa et al. | 340/573.1 |
| 2005/0039014 | A1* | 2/2005 | Sajkowsky | 713/172 |
| 2006/0087439 | A1* | 4/2006 | Tolliver | 340/573.1 |

FOREIGN PATENT DOCUMENTS

| | | |
|---|---|---|
| JP | 2000-011279 | 1/2000 |
| JP | 2000-028579 | 1/2000 |
| JP | 2003-014695 | 1/2003 |
| JP | 2005-122634 | 5/2005 |
| JP | 2005-322164 | 11/2005 |

* cited by examiner

*Primary Examiner* — Shirley Lu
(74) *Attorney, Agent, or Firm* — Antonelli, Terry, Stout & Kraus, LLP.

(57) ABSTRACT

Mass transit terrorism is prevented to construct a safe society. Individual explosive sensing devices are connected by a network to establish a security system. Information collected in the security center is compared with a database to determine a risk. When the risk exceeds a predetermined level upon determination of the risk, measures may be taken such that an alarm is activated and instructions for making a security guard carry out the parcel inspection of the person causing the risk are transmitted to the security guard. According to the present invention, the security can be enhanced while the social life is still convenient even when the explosive sensing device having a high throughput is employed at places such as mass transit where many people gather. Therefore, the terror risk on the mass transit can be reduced to contribute to construction of the safe society.

18 Claims, 4 Drawing Sheets

SECURITY SYSTEM, SECURITY CENTER APPARATUS, AND SECURITY MANAGEMENT METHOD

CLAIM OF PRIORITY

The present application claims priority from Japanese patent application JP 2008-011064 filed on Jan. 22, 2008, the content of which is hereby incorporated by reference into this application.

FIELD OF THE INVENTION

The present invention relates to a security system, a security center apparatus, and a security management method, which prevents terrorism or crime using explosives from occurring.

BACKGROUND OF THE INVENTION

Worldwide terror threats are more increasing. In recent years, methods of manufacturing explosives using articles of daily use are widely known, and terror and crime owing to the explosive also become threats to our daily life. Multiple acts of terror were reported in London, causing many casualties. In addition, a suspect who has planned the suicide bombing at a commuter train was reportedly arrested in Japan.

In order to prevent the terror or the crime beforehand, techniques of sensing dangerous substances are developed in various countries. For example, patent document 1[JP-A-2000-28579] disclose an explosive sensing device using a mass spectrometer. Vapors leaked from a baggage are collected by a sampling probe, are ionized using a negative corona discharge, and are detected using a mass spectrometer, thereby determining whether a dangerous substance is present.

A technique of using a mass spectrometer as a detecting section of a security system to enhance an inspection speed or test reliability is disclosed in patent document 2[JP-A-2003-14695]. This security system transmits a signal obtained in an analysis unit (a terminal system) to an assist system via a communication line, and the assist system determines whether a dangerous substance is present. The determination result of the assist system is transmitted to the terminal system via the communication line. By doing so, an operator manipulating the terminal system does not need to have a special knowledge or training.

In addition, a system for sensing an intrusion of a suspicious person is disclosed as an example of security device in patent document 3[JP-A-2005-122634]. According to this security device, a person detection sensor outputs an alarming trigger when the detection having the detection number not less than a predetermined value is continuously carried out for a predetermined time. By doing so, a recording amount of a security camera is not unnecessarily increased even at a building such as an apartment where many people come and go.

SUMMARY OF THE INVENTION

It is assumed that explosive sensing devices that have been developed are usually employed for an airport or important facilities. The devices are intended to inspect a small number of persons, so that they are not enough to be used for a mass transit where many people gather such as stations. For example, a false alarm rate of the explosive sensing device (that is, a probability of the responding explosive sensing device even when a person does not have explosives) is estimated to be about 30% in a parcel inspecting device using an X-ray, and about 0.1 to 1% in an inspecting device using a chemical analysis. For this reason, when the explosive sensing device is used for inspection on the entire passengers using the train, many people needs to be inspected each time when the explosive sensing device frequently responds to activate the alarm. Considering the false alarm rate and the number of passengers at a station, thousands or tens of thousands of alarm occur at major stations everyday, so that many people must be inspected each time when the modern explosive sensing device is used for inspection on the mass transit such as the station. In order to carefully inspect many people for the purpose of searching hidden explosives, many inspectors or a long time of inspection is required and social convenience of the mass transit is significantly lost, which are thus impractical.

Accordingly, an advanced sensing technique is required; however, measures must be desperately taken against the mass transit terrorism. And rapid measures must be taken for securing safety and security in our daily life.

For these reasons mentioned above, a security system is required which protects passengers or facilities of mass transits, business districts, event places, and so on against the bomb terror while maintaining the convenience of social life.

The invention is intended to provide a security system connecting individual explosive sensing devices to each other via a network. Information collected in a security center is compared with a database to determine a risk. Upon determination of the risk, when the risk exceeds a predetermined level, an alarm may be activated, and instructions for making a security guard carry out the parcel inspection of the person causing the risk may be transmitted to the security guard.

In detail, one aspect of the present invention is to provide a security system, which includes: a sensing unit including a detecting section of detecting a dangerous substance and an identification section of identifying an inspection object; an alarm activation unit that activates an alarm; a security center apparatus; and a communication line connecting the sensing unit, the alarm activation unit, and the security center apparatus to one another, wherein the sensing unit includes a unit of transmitting sensing information including at least detection information of the dangerous substance detected by the detecting section to the security center apparatus via the communication line, and the security center apparatus includes: a database where the sensing information received from the sensing unit is recorded together with a management number for managing the corresponding sensing information; a unit of comparing the sensing information with the sensing information of the management number having the same management number as the previous one recorded in the database; and a unit of determining a risk of the sensing information by including the sensing information of the management number having the same management number as the previous one based on a predetermined determination standard, wherein the security center apparatus makes the alarm activation unit activate the alarm via the communication line based on the result of the determination.

In the determination standard, the risk is determined to be high to cause alarm activation when a dangerous substance is detected by a predetermined number from a specific person.

The number of detection times required for up to the alarm activation is changed depending on the kind of the detected explosive.

In addition, false alarm rates of respective explosives are registered beforehand, the multiplication of the false alarm rates of the explosives from the plural detections is calculated, and the risk is determined to be high to cause alarm activation when the multiplication is less than a predetermined value.

In addition, an automatic ticket gate using an integrated chip (IC) card or a cellular phone is used as identification section of the sensing device, so that a person passing through the gate can be identified by an ID number allocated to the IC card or the cellular phone when a dangerous substance is sensed, and the sensing history can be managed without having to provide the sensing information with the management number in the security center apparatus.

According to the present invention, the security can be enhanced while the social life is still convenient even when the explosive sensing device having a high throughput is employed at places such as mass transit where many people gather. Therefore, the terror risk on the mass transit can be reduced to contribute to construction of the safe society.

DETAILED DESCRIPTION OF THE PREFERRED EMBODIMENTS

Hereinafter, embodiments of the present invention will be described in detail with reference to accompanying drawings.

Figure 1:
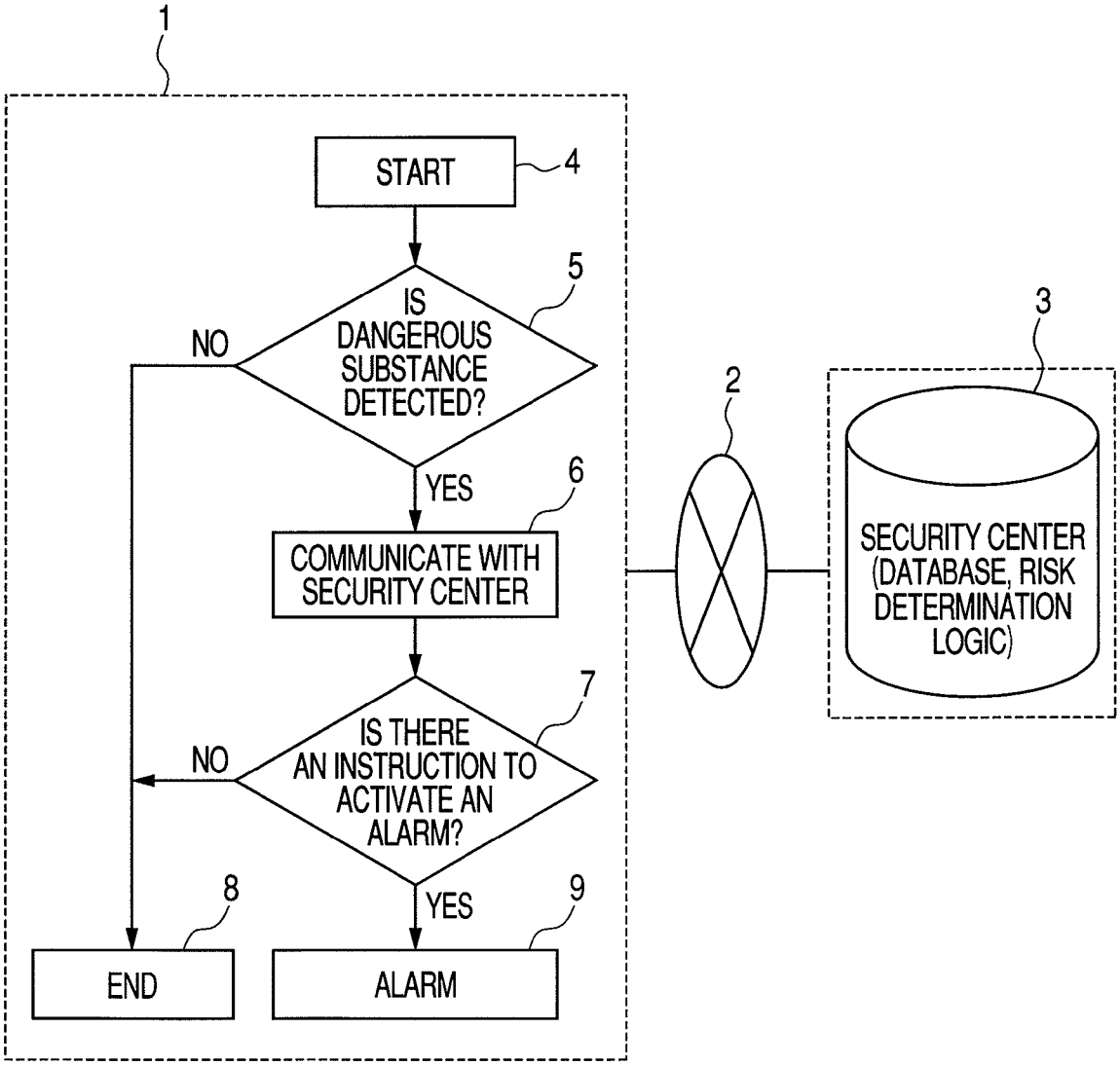
FIG. 1 is a diagram illustrating a security system according to the invention.

First, FIG. 1 illustrates an entire security system of the present invention. The security system of the present invention includes a sensing unit 1, a communication line 2, and a security center 3. The sensing unit 1 first initiates sensing to determine whether a dangerous substance is present (step 5). When the dangerous substance is present, it communicates with the security center 3 via the communication line 2 (step 6). A database, a risk determination logic, and so on are included in the security center 3. The security center 3 determines the risk, and instructs the sensing unit 1 to activate the alarm via the communication line 2 when the risk is determined to be dangerous, and activates the alarm when the activation instruction is issued (step 7).

When all signals from the sensing unit 1 are transmitted to the security center 3, it is expected that many times are taken to process the communication or data due to an enormous amount of information. In addition, privacy is involved, so that recording actions of the inspection object (e.g., person) in detail makes it difficult to arrive at a social agreement. Accordingly, the present invention allows data of the inspection object and the sensed result to be transmitted to the security center 3 after the dangerous substance is sensed by the sensing unit 1. The security center 3 provides the inspection object in which the dangerous substance is detected with an ID, and manages its history. By doing so, sensed results of the plural sensing units 1 can be collectively managed, and the social security can be enhanced without having to applying a significant load to the information system of the security center 3.

First Embodiment

Figure 2:
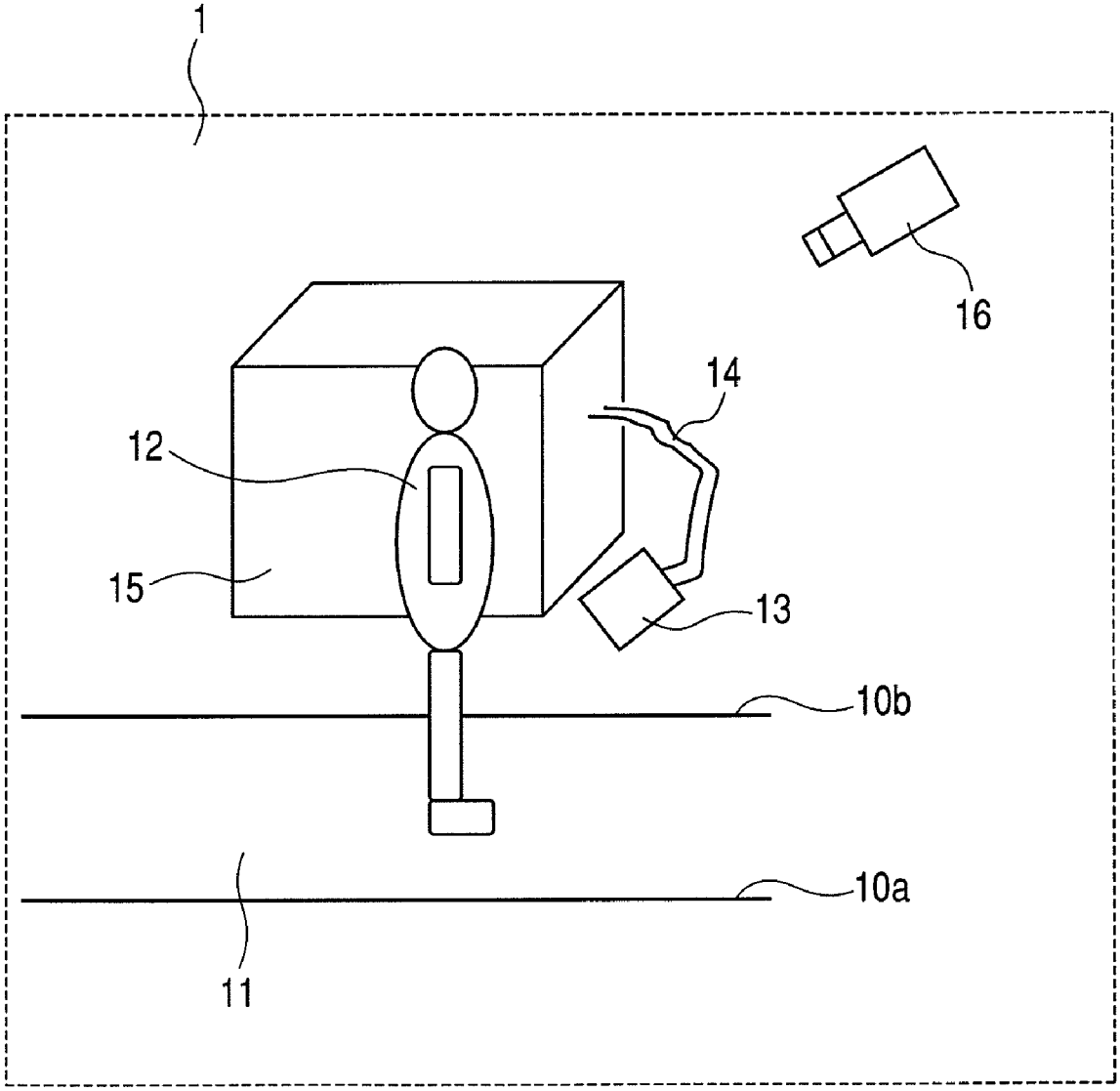
FIG. 2 is a diagram illustrating an example of a sensing unit according to the present invention.

FIG. 2 illustrates an example of the sensing unit 1 according to the present invention. A detecting section and a individual identification section are included in the sensing unit. In this case, an example of using the mass spectrometer 15 as the detecting section and the security camera 16 as the individual identification section will be described. A portion surrounded by the lines 10*a* and 10*b* indicating the inspection area is referred to as an inspection area 11. The mass spectrometer 15 inspects whether an inspection object passing through the inspection area 11, for example, a person 12 has an explosive. The combination of the inspection area and the inspection object may be a baggage (inspection object) mounted on a conveyor belt (inspection area). The air blown from the inlet probe 13 is delivered to the mass spectrometer 15 through the sample introduction pipework 14. The mass spectrometer 15 inspects whether an explosive component is contained in the air. Specifically, a mass spectrum is obtained, which is compared with the database prepared in the mass spectrometer 15 in terms of the ion intensity and the mass-to-charge ratio (m/z) of the detected ions, thereby determining whether the dangerous substance is present. This kind of processing of determining the presence or absence of the dangerous substance includes various methods (e.g., an ion mobility method, a chemiluminescence method, a laser-induced fluorescence detection method, and so on), so that these methods may be employed without being limited to the mass spectrometer method. When it is determined that the dangerous substance is present, the determination result and images taken by the security camera 16 are transmitted to the security center 3 via the communication line 2 and are processed. When instructions of activating the alarm are delivered to the sensing unit from the security center 3 via the communication line 2, the sensing unit 1 activates the alarm. An alarm activation method may include putting a device emitting sound or light into the mass spectrometer 15 and driving the device, installing the device at a room of a security guard and alarming the security guard, closing the inspection area 11 using a partition, and so on.

Figure 3:
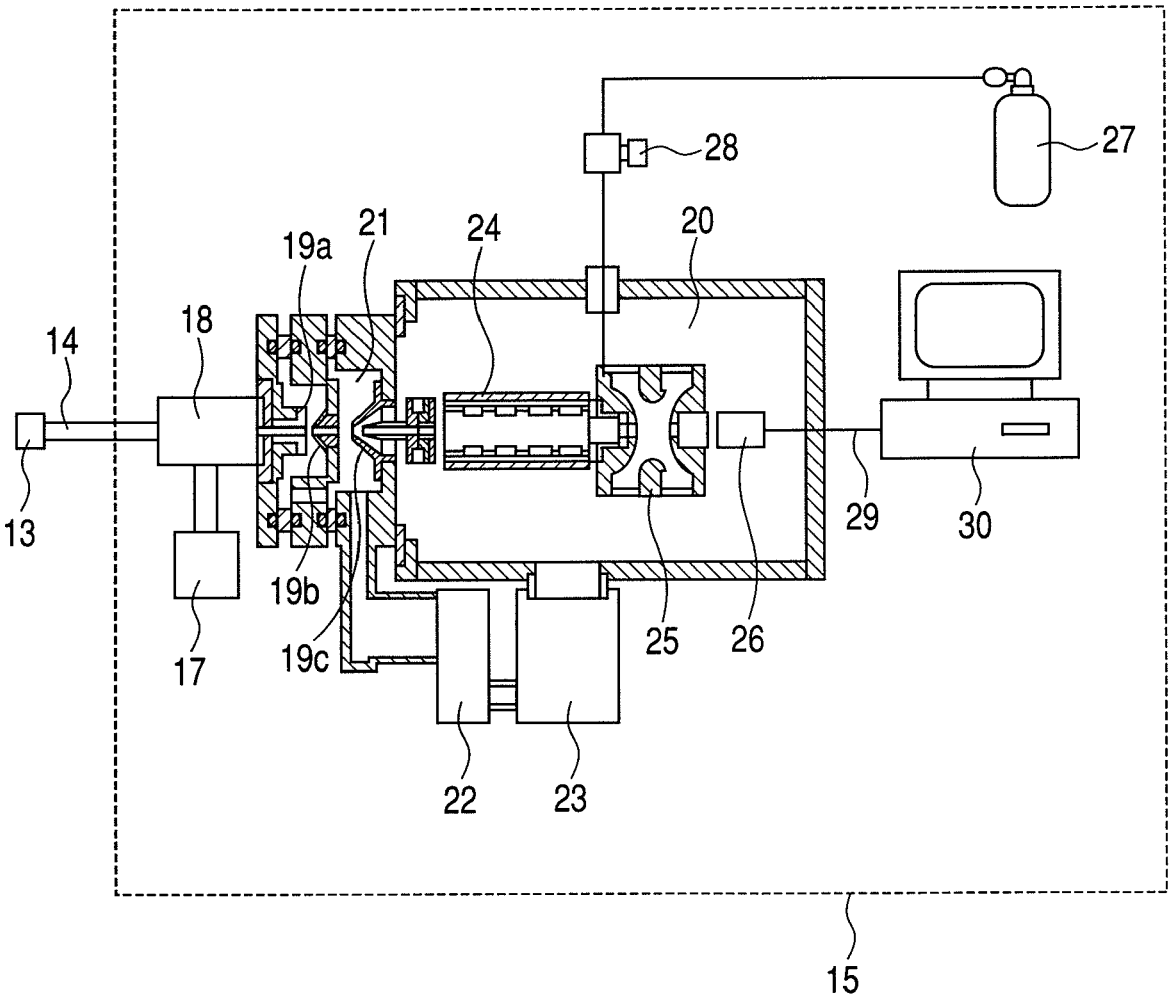
FIG. 3 is a diagram illustrating an example of using a mass spectrometer as a detecting section according to the present invention.

FIG. 3 illustrates a specific example of the mass spectrometer according to the present invention. The air near the inspection object is introduced into the ionization source 18 via the inlet probe 13 and the sample introduction inlet pipework 14 by the inlet pump 17. An atmospheric pressure chemical ionization source using a negative corona discharge disclosed in patent document 1 may be employed as the ionization source 18. Ions generated in the ionization source 18 are introduced into the vacuum portion 20 through apertures 19*a*, 19*b*, and 19*c*. When the ions are introduced from the atmosphere to the vacuum portion, the differential pumping unit 21 evacuated by the roughing vacuum pump 22 are installed. The roughing vacuum pump 22 may be used as a pump for evacuating a latter part of the turbo molecular pump 23 of evacuating the vacuum portion 20. The ions introduced into the vacuum portion 20 are converged by the ion focusing unit 24, are mass-analyzed by the mass analysis unit 25, and are detected by the ion detecting unit 26. When ion trapping is used for the mass analysis unit 25, a helium gas is introduced into the mass analysis unit 25 from the cylinder 27 through the flow meter 28. Signals detected by the ion detector 26 are delivered to the data processing unit 30 via the signal line 29, thereby processing data or determining whether the dangerous substance is present.

Figure 4:
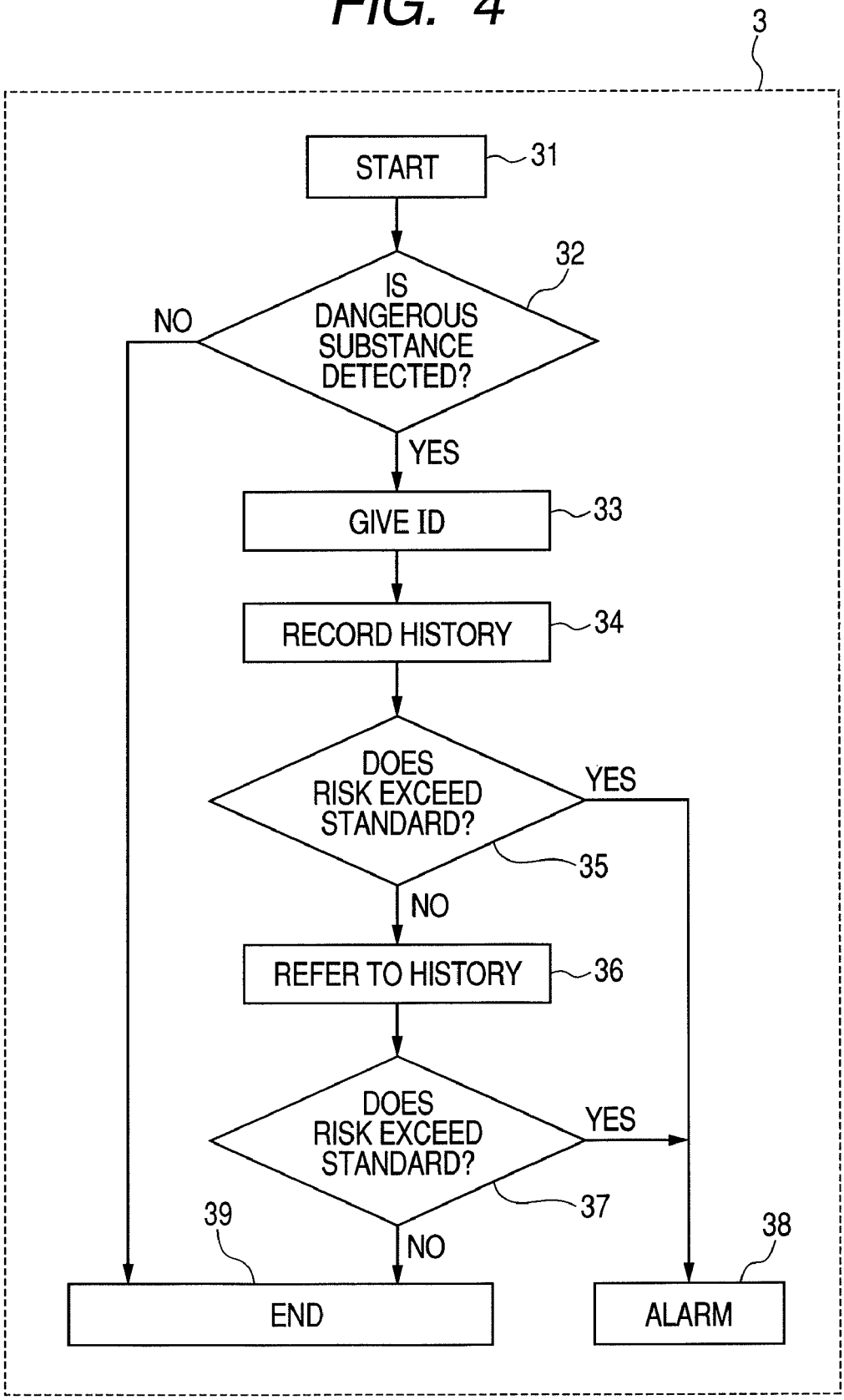
FIG. 4 is a diagram illustrating a determination method in a security center according to the present invention.

Determination of the risk in the security center 3 will be described with reference to FIG. 4. The communication that the dangerous substance was detected by the sensing unit 1 together with the images of the security camera is sent to the security center 3, so that the security center first checks whether the dangerous substance is detected (step 32). The security center 3 provides the detection signal and the images of the security camera with IDs for facilitating subsequent recording (step 33). And a history involving the ID, detection time, detection signal (or detection content), images of the security camera, and so on is recorded in the database (step 34). The security center determines the risk on the single event (detection of the dangerous substance) (step 35), and instructs the sensing unit 1 to activate the alarm when the detection exceeds a predetermined risk (step 38). When it is determined that the detection does not exceed the predetermined risk in the single event, the risk is referred to its past history (step 36). The risk determination is carried out again by including the past history (step 37), and the sensing unit 1 is instructed to activate the alarm (step 38) when the detection is determined to exceed the predetermined risk.

Next, a method of determining the risk in the steps 35 and 37 will be described. The sensing unit using the mass spectrometer may have less false alarm rates; however, the false alarm rate of about 0.1% (e.g., the case that the signal of the dangerous substance is obtained even when an inspection object does not have an explosive) is generated when the sensing unit is used in the sensing field. When the inspection is performed on every passenger at a big station, hundreds of false alarms are generated everyday, so that it is not practical to carry out parcel inspection each time when the false alarm is generated.

In general, security levels may be set depending on the degree of terrorism. For example, three steps for the terror are set such that the security level representing "low" indicates typical cases having a lower danger level, the security level representing "medium" indicates that there is a terror rumor or a transportation system terror has occurred in other countries, and so on, and the security level representing "high" indicates that a terror is evidently under the plan or a terror has actually occurred in homeland. The supervisor of the security center may set the risk determination of the security system referring to the security level.

When the security level is high, safety is more emphasized than convenience to activate the alarm in a single event by the step 35.

When the security level is low and medium, it is avoided to activate the alarm in the single event, and the risk is determined using the past history by the step 37. A technique of identifying an individual from the images of the security camera recorded by the step 34 is a biometric technique, which is under research day by day, so that its authentication technique may be utilized. For example, a method of extracting feature points of a face, that is, contours of the face, or positions of eyes and noise, and so on, is well known in the art. The sensing history is provided with the ID by the step 33 and is recorded by the step 34 is referred by the step 36, whether the same person has the history sensed in the past is referred to by the step 36, and the risk is determined again by the step 37 depending on the referred result.

Some examples of the method of determining the risk in the step 37 will be described.

(1) When the Number of Sensing is Referred as the Standard

The security center 3 collectively manages signals output from the sensing units 1 deployed nationwide, and determines that the risk is high when the dangerous substance of the same kind is sensed several times within a predetermined time from the same person. For example, when trinitrotoluene (this is a representative component of a military explosive, which is referred to as TNT) is detected at least two times within 24 hours from the same person by any one of the sensing units, it is determined that the risk is high. The probability of the false alarm is low, so that the parcel inspection does not need to be unnecessarily carried out when the risk is determined to be high based on the plural sensing histories.

At this time, it is effective to change the number of determining the high risk depending on the kind of the explosive. Most explosives used for the crime in Japan are black powder (fireworks powder). However, the black powder has a low destructive power, so that it can not cause a significant damage with its small amount. In addition, it may be expected that traces of the black powder are left on children's clothes after they are playing with the fireworks. Accordingly, the black powder may be determined to have a high risk by plural sensing (e.g., 10 times) so that the alarm may be activated. That is, degrees of threat for various explosives such as a military explosive, an industrial explosive, and a improvised explosive may be set to determine that a small number of sensing corresponds to the high degree of threat and a big number of sensing corresponds to the low degree of threat.

(2) When the False Alarm Rate is Referred to as the Standard

It was described that the false alarm rate of the sensing unit using the mass spectrometer is about 0.1%; however, this means that the total sum of false alarm rates of various explosives registered in the database are about 0.1%. Various explosives have different false alarm rates depending on their components. The component used only for the military explosive tends to have a low false alarm rate and the component used also for articles of daily use tends to have a high false alarm rate.

Accordingly, when kinds and false alarm rates of explosives are registered in the database and the dangerous substance is sensed several times within a predetermined time for the same person, the risk is determined to be high when the multiplication of the false alarm rates is not greater than a predetermined level. For example, it is assumed that the false alarm rate of the explosive A is $10^{-2}$, the false alarm rate of the explosive B is $10^{-3}$, the false alarm rate of the explosive C is $10^{-6}$, and the standard for the risk determination is not greater than the false alarm rate of $10^{-6}$. In this case, the case when the explosive A is sensed three times, the case when the explosive B is sensed two times, and the case when the explosive C is sensed one time, reach the predetermined standard, thereby activating the alarm.

The false alarm rate of $10^{-6}$ requires the people to be inspected, since one alarm is activated per one day at a big station, which is socially tolerable.

When the risk is determined to be high as a result of the risk determination as mentioned above, an instruction is given to the sensing unit 1 by the step 38 so that the sensing unit activates the alarm in the step 37. The method of determining the risk based on the false alarm rate is particularly effective in the sensing unit using ion mobility in the detecting section, wherein the ion mobility is considered to have a higher false alarm rate than the mass spectrometer.

When the sensing unit 1 shown in FIG. 2 is installed in every ticket gate of the railroad and sensing information from the whole sensing units is collectively managed in the security center, for example, the suicide bomber that happened in London and aimed at the mass transit such as multiple terrors of subway and bus can be prevented beforehand without affecting social convenience Second Embodiment According to the first embodiment, the security camera was used as the individual identification section. However, the method of identifying the individuals is not limited to the security camera, but may employ a biological authentication technique of comparing biological patterns such as fingerprints or finger veins.

In addition, automatic ticket gates using the IC card are widely used in the metropolitan stations or subways. The chemical material attached to clothes or hands when the person passes through this automatic ticket gate may be analyzed to determine whether the person has a dangerous substance. When the dangerous substance is sensed, the person passing through the gate is identified by the ID number allocated to the IC card, so that the sensed signal and the ID number of the IC card may be transmitted to the security center for recording the history, thereby managing the sensing history without having to use the security camera or the biological authentication device. In addition, recently, instead of the IC card, a cellular phone that is registered in advance may be brought into contact with the automatic ticket gate, so that the ID number given to the cellular phone may be used for identification in this case.

The present invention has been described with respect to the case of using the mass spectrometer as the detecting section, however, a so-called trace sensing unit of performing the sensing by analyzing fine particles or vapors of the dangerous substance may be employed likewise. An example of the trace sensing may use an ion mobility method or a chemiluminescence method.

Specific explosives may be frequently detected from a specific person in the present invention. For example, a component of a military explosive may be detected from a self-defense official, a component of an industrial explosive may be detected from an employee of an explosive manufacturing factory, or a component of black powder may be detected from a fireworks artisan. In these cases, the supervisor of the security center, considering a job carrier of a specific individual, may change the setting of the security center per specific individual such that the alarm activation is cancelled when the specific explosive from the specific individual is detected.

According to the present invention, plural explosive sensing units may be connected to each other via a network to establish a reasonable terror monitoring network. Therefore, safety and security can be enhanced while the convenience of social light is kept.

What is claimed is:

1. A security system comprising:

a detecting unit that detects a dangerous substance;

an identification section unit that identifies an inspection object;

an alarm activating unit that activates an alarm;

a security center apparatus; and a communication line that connects the detecting unit, the alarm activating unit, and the security center apparatus to one another, wherein the detecting unit includes a unit that transmits sensing information including at least detection information of the dangerous substance detected by the detecting unit, to the security center apparatus via the communication line, wherein the security center apparatus provides the sensing information with a management number:

wherein the security center apparatus includes:

a database where the sensing information including the at least detection information of the dangerous substance detected by the detecting unit, and received from the detecting unit, is recorded together with the management number, as a dangerous substance entry for managing the sensing information;

a unit that compares the entry of the sensing information with entries of other sensing information previously recorded in the database, to determine multiple dangerous substance entries which have a same said management number; and a determination unit that determines a risk of the sensing information by considering the multiple dangerous substance entries in view of a predetermined determination standard;

wherein the security center apparatus makes the alarm activating unit activate the alarm via the communication line, based on the result of the determination;

wherein there are plural detecting units, and the plural detecting units communicate with the security center apparatus via the communication line; and wherein the predetermined determination standard is different for each management number of a plurality of management numbers.

2. The security system according to claim 1, wherein an automatic ticket gate where an integrated chip (IC) card is used is employed as the identification section unit, and an identification number allocated to the IC card is used as the management number.

3. The security system according to claim 1, wherein the determination standard is a number of detection times that a dangerous substance of a same kind is detected from a same inspection object by the detecting unit, and makes the alarm activating unit activate the alarm when the dangerous substance of the same kind is detected from the same inspection object for a predetermined number of detection times.

4. The security system according to claim 3, wherein the number of detection times required for making the alarm activating unit activate the alarm, is different depending on the kind of the dangerous substance in the determination standard.

5. The security system according to claim 1, wherein the determination standard is a false alarm rate depending on a kind of the dangerous substance, and wherein the determination unit calculates a multiplication of false alarm rates according to dangerous substances of a same kind detected from a same inspection object, and makes the alarm activating unit activate the alarm when the multiplication is greater than a predetermined value.

6. The security system according to claim 1, wherein the detecting unit is a mass spectrometer.

7. A security system comprising:

a detecting unit that detects a dangerous substance derived from an inspection object, and outputs sensing information including at least detection information of the dangerous substance detected by the detecting unit;

an identification section unit that identifies the inspection object, and outputs a management identifier related to the inspection object;

an alarm activating unit that can activate an alarm;

a security center apparatus; and a communication system coupling the detecting unit, the identification section unit, the alarm activating unit, and the security center apparatus to one another, wherein the security center apparatus is configured to:

obtain the sensing information including the at least detection information of the dangerous substance detected by the detecting unit, and the management identifier related to the inspection object, via the communication system, associate the sensing information with the management identifier:

manage a database where the sensing information is associated with the management identifier, as a dangerous substance entry for managing the sensing information;

compare the entry of the sensing information with entries of other sensing information previously recorded in the database, to determine multiple dangerous substance entries which have a same said management identifier; and determine a risk of the sensing information by considering the multiple dangerous substance entries in view of a predetermined determination standard;

decide whether to make the alarm activating unit activate the alarm via the communication system, based on the determination of the risk;

wherein there are plural detecting units, and the plural detecting units communicate with the security center apparatus via the communication system; and wherein the predetermined determination standard is different for each management identifier.

8. The security system according to claim 7, wherein an automatic ticket gate where an integrated chip (IC) card is used is employed as the identification section unit, and an identification number allocated to the IC card is used as the management identifier.

9. The security system according to claim 7, wherein the determination standard is a number of detection times that a dangerous substance of a same kind is detected from a same inspection object by the detecting unit, and makes the alarm activating unit activate the alarm when the dangerous substance of the same kind is detected from the same inspection object for a predetermined number of detection times.

10. The security system according to claim 9, wherein the number of detection times required for making the alarm activating unit activate the alarm, is different depending on the kind of the dangerous substance in the determination standard.

11. The security system according to claim 7, wherein the determination standard is a false alarm rate depending on a kind of the dangerous substance, and wherein the determination unit calculates a multiplication of false alarm rates according to dangerous substances of a same kind detected from a same inspection object, and makes the alarm activating unit activate the alarm when the multiplication is greater than a predetermined value.

12. The security system according to claim 7, wherein the detecting unit is a mass spectrometer.

13. A security system comprising:

a detecting unit that detects a dangerous substance derived from an inspection object, and outputs sensing information including at least detection information of the dangerous substance detected by the detecting unit;

an identification section unit that identifies the inspection object, and outputs a management identifier related to the inspection object;

an alarm activating unit that can activate an alarm;

a security center apparatus; and a communication system coupling the detecting unit, the identification section unit, the alarm activating unit, and the security center apparatus to one another, wherein the security center apparatus is configured to:

obtain the sensing information including the at least detection information of the dangerous substance detected by the detecting unit, and the management identifier related to the inspection object, via the communication system, associate the sensing information with the management identifier:

manage a database where the sensing information is associated with the management identifier, as a dangerous substance entry for managing the sensing information;

determine a risk of the sensing information by considering a predetermined determination standard and the management identifier of a dangerous substance entry, wherein the predetermined determination standard is different for each different management identifier; and decide whether to make the alarm activating unit activate the alarm via the communication system, based on the determination of the risk;

wherein there are plural detecting units, and the plural detecting units communicate with the security center apparatus via the communication system.

14. The security system according to claim 13, wherein an automatic ticket gate where an integrated chip (IC) card is used is employed as the identification section unit, and an identification number allocated to the IC card is used as the management identifier.

15. The security system according to claim 13, wherein the determination standard is a number of detection times that a dangerous substance of a same kind is detected from a same inspection object by the detecting unit, and makes the alarm activating unit activate the alarm when the dangerous substance of the same kind is detected from the same inspection object for a predetermined number of detection times.

16. The security system according to claim 15, wherein the number of detection times required for making the alarm activating unit activate the alarm, is different depending on the kind of the dangerous substance in the determination standard.

17. The security system according to claim 13, wherein the determination standard is a false alarm rate depending on a kind of the dangerous substance, and wherein the determination unit calculates a multiplication of false alarm rates according to dangerous substances of a same kind detected from a same inspection object, and makes the alarm activating unit activate the alarm when the multiplication is greater than a predetermined value.

18. The security system according to claim 13, wherein the detecting unit is a mass spectrometer.

* * * * *